United States Patent [19]

Cerankowski et al.

[11] 4,456,674

[45] Jun. 26, 1984

[54] COLOR TRANSFER PHOTOGRAPHIC PROCESSES AND PRODUCTS

[75] Inventors: Leon D. Cerankowski, Carlisle; Gary S. LaPointe, Beverly; Neil C. Mattucci, Billerica, all of Mass.

[73] Assignee: Polaroid Corporation, Cambridge, Mass.

[21] Appl. No.: 516,597

[22] Filed: Jul. 25, 1983

Related U.S. Application Data

[63] Continuation-in-part of Ser. No. 437,896, Nov. 1, 1982, abandoned.

[51] Int. Cl.[3] ..... G03C 5/54; G03C 1/84; G03C 7/00; G03C 1/40

[52] U.S. Cl. ..... 430/221; 430/227; 430/236; 430/244; 430/447; 430/486; 430/490; 430/449; 430/517; 430/520

[58] Field of Search ..... 430/221, 220, 212, 214, 430/216, 218, 447, 486, 491, 517, 520, 236, 227, 244, 449

[56] References Cited

U.S. PATENT DOCUMENTS

| | | | |
|---|---|---|---|
| 3,415,644 | 10/1968 | Land | 430/220 |
| 3,415,645 | 10/1968 | Land | 430/220 |
| 3,415,646 | 10/1968 | Land | 430/220 |
| 3,647,437 | 3/1972 | Land | 430/221 |
| 3,702,244 | 1/1972 | Bloom et al. | 430/221 |
| 3,702,245 | 1/1972 | Simon | 430/221 |
| 3,776,726 | 12/1973 | Land | 430/212 |
| 3,856,521 | 12/1974 | Bilofsky et al. | 430/214 |
| 4,028,103 | 6/1977 | Hannie | 430/218 |
| 4,144,065 | 3/1979 | Lambert et al. | 430/212 |
| 4,298,674 | 11/1981 | Land et al. | 430/221 |
| 4,356,250 | 10/1982 | Irani et al. | 430/216 |
| 4,367,277 | 1/1983 | Chiklis et al. | 430/221 |

*Primary Examiner*—Richard L. Schilling
*Attorney, Agent, or Firm*—Sybil A. Campbell

[57] ABSTRACT

This invention relates to diffusion transfer processes and products wherein the transmission density of the pigmented processing composition layer is increased by employing an alkali earth metal salt to increase the light-absorbing ability of a carboxynaphthol phthalein optical filter agent within said processing composition layer. In another embodiment, a carboxyindole phthalein optical filter agent also is included in said processing composition layer, and a zinc or cadmium salt is employed to shift the spectral absorption of the carboxyindole phthalein into the green region of the visible spectrum. In a further embodiment, a calcium salt is employed in a viscous pigmented processing compositon comprising a light-reflecting pigment, colloidal silica and a metal chelating agent, e.g., an alkylene polyamine polyacetic acid to stabilize the spreading characteristics of the compositions.

49 Claims, 4 Drawing Figures

COLOR TRANSFER PHOTOGRAPHIC PROCESSES AND PRODUCTS

CROSS-REFERENCE TO RELATED APPLICATIONS

This application is a continuation-in-part of our copending application Ser. No. 437,896 filed Nov. 1, 1982 and now abandoned.

BACKGROUND OF THE INVENTION

1. Field of the Invention

This invention relates to photography, and more particularly, it relates to photographic processes performed in ambient light and to photographic products useful in such processes.

2. Description of the Prior Art

A number of diffusion transfer processes for producing photographic images in both black-and-white and in color are now well known. Of particular interest are diffusion transfer processes wherein the image-receiving layer carrying the transfer image is not separated from the developed photosensitive layer(s) after processing but both components are retained together as a permanent laminate. Included as part of the laminate is a layer of a light-reflecting material, preferably titanium dioxide, positioned between the image-carrying layer and the developed photosensitive layer(s). The light-reflecting layer separating the image-carrying and photosensitive components provides a white background for the transfer image and masks the developed photosensitive layer(s). In addition to these layers, the laminate usually includes dimensionally stable outer layers or supports, at least one of which is transparent so that the resulting transfer image may be viewed by reflection against the background provided by the light-reflecting layer. Diffusion transfer processes for forming images viewable without separation of the photosensitive and image-receiving components and film units useful in such processes are described, for example, in U.S. Pat. Nos. 3,415,644, 3,415,645 and 3,415,646 issued Dec. 10, 1968 to Edwin H. Land.

U.S. Pat. No. 3,647,437 issued Mar. 7, 1972 to Edwin H. Land also is concerned with diffusion transfer processes wherein the resulting photograph comprises the developed photosensitive layer(s) retained with the image-receiving layer as part of a permanent laminate. In the processes disclosed in this patent, a photographic film unit comprising a photosensitive element is developed in ambient light but further undesired exposure during processing is prevented by a light-absorbing material or optical filter agent which is retained in the processed film unit. In a preferred embodiment, the optical filter agent is a pH-sensitive dye, i.e., a dye possessing spectral absorption characteristics that are reversibly alterable in response to changes in environmental pH and particularly, a pH-sensitive dye having a colored or light-absorbing form above a given alkaline pH and a colorless or non-light-absorbing form below said pH. Examples of pH-sensitive dyes found particularly useful as light-absorbing optical filter agents are the phthaleins, i.e., the phthalide and naphthalide dyes derived from indoles disclosed in U.S. Pat. No. 3,702,244 issued Nov. 7, 1972 to Stanley M. Bloom, Alan L. Borror, Paul S. Huyffer and Paul T. MacGregor and the phthalide and naphthalide dyes derived from 1-naphthols disclosed in U.S. Pat. No. 3,702,245 issued Nov. 7, 1972 to Myron S. Simon and David P. Waller. As discussed in these and other patents, a combination of the indole and 1-naphthol dyes generally is used where it is desired to provide protection from post-exposure fogging throughout the visible spectrum.

In a particularly useful embodiment disclosed in said U.S. Pat. No. 3,647,437, the film unit is of the type described in aforementioned U.S. Pat. No. 3,415,644 and comprises a first sheet-like component comprising an opaque support carrying a silver halide emulsion layer(s) and a second sheet-like component comprising a transparent support carrying an image-receiving layer which are in fixed relationship prior to exposure, which relationship is maintained after processing. After photoexposure through said transparent support, an aqueous alkaline processing composition is distributed in a thin layer between said components. The processing composition contains a light-reflecting pigment and at least one light-absorbing optical filter agent, such as, one of the aforementioned phthalein dyes which is in its colored form at the initial pH of said aqueous alkaline processing composition and which, after at least the initial stages of processing, is converted to its colorless form by reducing the environmental pH, for example, by including an acid-reacting layer as part of the film unit. The concentrations of the light-reflecting pigment and light-absorbing optical filter agent required to provide adequate protection of the photosensitive layer(s) will vary with the process being performed and the anticipated conditions, e.g., light intensity, dark time, etc. Preferably, the concentrations of these materials are such that the processing composition layer containing the pigment and filter agent will have a transmission density of at least about 6 but a reflection density not greater than about 1.

U.S. Pat. No. 4,298,674 issued Nov. 3, 1981 to Edwin H. Land, Leon D. Cerankowski and Neil Mattucci discloses diffusion transfer processes wherein the optical filter agent contained in the pigmented processing composition layer is decolorized adjacent the interface of the processing composition layer and image-receiving component in order to render the interface or image viewing background substantially "white" initially and throughout processing. Since this decolorization is limited to a small concentration of optical filter agent adjacent said interface, the transmission density of the processing composition layer is not reduced to any significant extent, and thus, adequate protection from post-exposure fogging is provided until such time as it is desired to decolorize the remaining optical filter agent.

As described in said U.S. Pat. No. 4,298,674, the decolorization of the optical filter agent at said interface is achieved by employing film units wherein the image-receiving component carries a layer containing a substantially non-diffusible agent adapted to reduce the light-absorbing ability of the optical filter agent immediately adjacent the interface between said layer and the pigmented processing composition layer without reducing the light absorbing ability of the optical filter within said processing composition layer. In a preferred embodiment, the decolorization agent is a neutral polymeric material, such as a polyvinyl pyrrolidone or a polyether, which material is believed to effect decolorization in aqueous alkali by forming a complex with a salt of the pH-sensitive optical filter agent formed with the cation of said alkali, e.g., $K^+$, wherein the complex exhibits a higher apparent pKa than the pH-sensitive dye. Because of the increase in apparent pKa, decolorization occurs without a reduction in pH. The polmeric ethers in particular exhibit a propensity for binding many cations, thus becoming a "super cation" which changes the apparent pKa of the pH-sensitive phthalein dye.

SUMMARY OF THE INVENTION

According to one embodiment of the present invention, it has been found that the tendency of pH-sensitive phthalein dyes to bind metal cations may be employed to increase the light-absorbing ability of the dye within the layer of processing composition and that this increase in light-absorption can be achieved while still permitting selective decolorization at the image layer interface if desired. In particular, it has been found that the transmission density of the pigmented processing reagent can be increased at fixed phthalein dye concentration by the addition of a predetermined amount of alkali earth metal chloride or other alkali earth metal salt. Presumably, the increase in transmission density results from a lowering of dye pKa via cation exchange of the alkali earth metal cation, e.g., $Ba^{++}$ for the alkali metal cation of the reagent, e.g., $K^{+}$ at the carboxynaphthol moiety of the phthalein dye.

In addition to the use of alkali earth metal cation, a further increase in opacification in the green region of the visible spectrum may be achieved by employing certain bivalent transition metal cations. In this regard, it has been observed that zinc and cadmium also have a tendency to complex with phthalein dyes and that the complexing of zinc and cadmium with carboxyindole phthalein, presumably by binding with indole nitrogen, produces a spectral shift in dye $\lambda max$ from the mid-400 nm range to over 500 nm. The resulting increase in green absorption provides an increase in transmission density of the pigmented processing composition layer in the spectral region where opacification failures first manifest themselves using lesser quantities of processing composition, i.e., thinner layers of reagent.

These means of enhancing the opacification of the pigmented processing composition layer provide added protection in areas of thin reagent spreading and added protection in systems in which thinner layers of processing composition are desired. Also, by increasing the light-absorbing ability of the phthalein dye(s) at a fixed dye concentration, the deleterious effects on the transfer of image dye evoked by increasing density through actual increases in phthalein dye concentrations is avoided.

According to another embodiment of the present invention, it has been found that the inclusion of calcium cation in certain aqueous alkaline processing compositions provides a further beneficial effect. In particular, it has been found that the addition of calcium chloride or other alkali soluble calcium salt to viscous aqueous alkaline processing compositions comprising a light-reflecting pigment, colloidal silica and a metal chelating agent, e.g., an alkylene polyamine polyacetic acid acts as a preservative and postpones undesirable changes in the spreading characteristics of the composition.

It is, therefore, the primary object of the present invention to provide diffusion transfer products and processes employing an opacification system comprising a processing composition layer comprising aqueous alkali containing a light-reflecting pigment, a light-absorbing phthalein optical filter agent possessing a carboxynaphthol moiety and an alkali earth metal salt in an amount sufficient to increase the transmission density of said processing composition layer.

It is another object of the present invention to provide an opacification system of the foregoing type which additionally includes a light-absorbing phthalein optical filter agent possessing a carboxyindole moiety and, preferably also includes a zinc and/or cadmium salt in an amount sufficient to increase the transmission density of said processing composition layer in the green region of the visible spectrum.

It is a yet another object of the present invention to employ said opacification systems in diffusion transfer products and processes wherein the image-receiving component carries a layer containing a substantially non-diffusible agent adapted to decolorize said light-absorbing phthalein optical filter agent immediately adjacent the interface between said processing composition layer and said layer containing said decolorizing agent.

It is a further object of the present invention to provide pigmented photographic processing compositions having improved spreading characteristics.

Other objects of this invention will in part be obvious and will in part appear hereinafter.

The invention accordingly comprises the processes involving the several steps and the relation and order of one or more of such steps with respect to each of the others, and the products possessing the features, properties and relation of elements which are exemplified in the following detailed disclosure, and the scope of the application of which will be indicated in the claims.

For a fuller understanding of the nature and objects of the invention, reference should be had to the following detailed description taken in conjunction with the accompanying drawings.

BRIEF DESCRIPTION OF THE DRAWINGS

In FIG. 2 curve B represents processing composition with 1.5% barium chloride added, in FIG. 3 curve C represents processing composition with 0.25% zinc chloride added, and in FIG. 4 curve D represents processing composition with 1.5% cadmium chloride added.

DETAILED DESCRIPTION OF THE INVENTION

Figure 1:
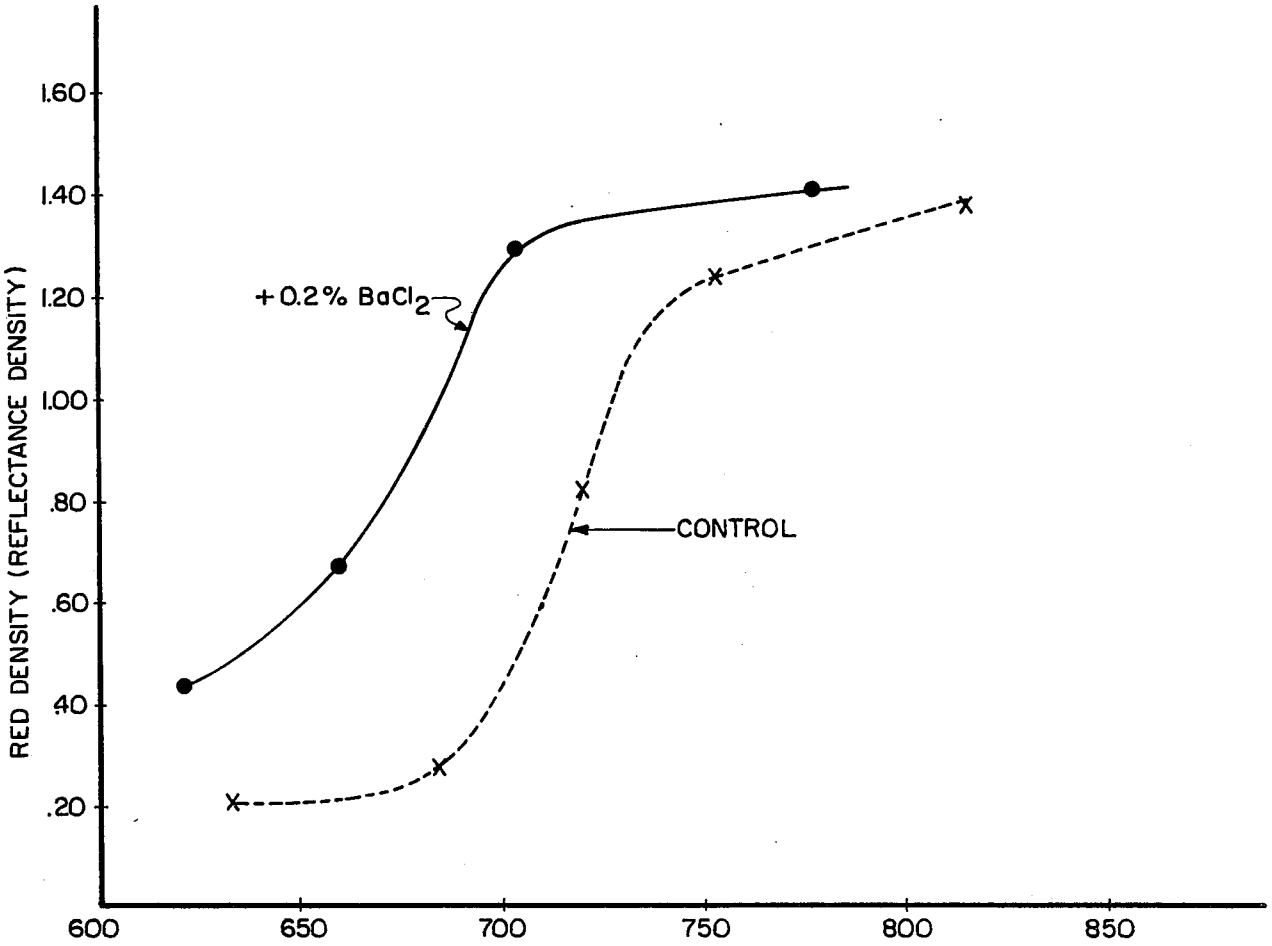
FIG. 1 is a graphic illustration showing the red reflectance densities measured for a series of color transfer images processed with 0.2% barium chloride added to the processing composition compared to a series of color transfer images processed without barium cation in the processing composition plotted against the quantity of processing composition employed in the preparation of images.

As noted above, it has been found that it is possible to increase the optical density of solutions of pH-sensitive carboxynaphthol phthalein dyes by adding alkali earth metal cation. As used herein, the term "carboxynaphthol phthalein" is intended to include both 3,3-di(4'-hydroxy-1'-naphthyl)-phthalides and 3,3-di(4'-hydroxy-1'-naphthyl)-naphthalides wherein at least one of said 3,3-substituents is a 3'-carboxy-4'-hydroxy-1'-naphthyl moiety. Because they are more efficient cation binders and because they are less diffusible in the processing composition layer, the carboxy-naphthol phthaleins preferably possess a long chain substituent, for example, a long chain alkoxy group.

Though any of the alkali earth metal cations may be employed to increase the absorption of these dyes, these metal cations differ in their relative capacity to complex the carboxynaphthol phthaleins. For example, at a given concentration, barium complexes these dyes most strongly followed in order by calcium, strontium and magnesium. Because barium and calcium are more efficient and can provide the desired increase in light-absorbing ability at lower cation concentrations, their use is preferred and particularly, the use of barium. Usually, these metal cations are introduced as alkali earth metal chlorides but other alkali soluble salts may be employed if desired.

To provide further protection throughout the visible spectrum, a second light-absorbing optical filter agent which absorbs in the shorter wavelength range of the visible spectrum, usually a carboxyindole phthalein is used in combination with the carboxynaphthol phthalein. The term "carboxyindole phthalein" as used herein is intended to include both 3,3-di(indol-3'-yl)phthalides and 3,3-di(indol-3-yl)naphthalides wherein at least one of said 3,3-substituents is a 7-carboxyindol-3-yl moiety. Like the carboxynaphthol dyes, the carboxyindole phthaleins preferably are relatively immobile in the opacification layer and are substituted with a long chain substituent such as a long chain alkyl or alkoxy group or a tailed sulfonamido or sulfamoyl group.

Though alkali earth metal cations do not appear to affect the carboxyindole phthaleins, it has been found that zinc and cadmium cations selectively shift the absorption spectrum of the indole dyes into the green region of the visible spectrum thereby increasing the transmission density of the opacification layer in the wavelength range where light leaks are most apt to occur. Zinc and cadmium cations also complex with the carboxynaphthol phthaleins but tend to precipitate rather than to increase the light-absorbing ability of these dyes. Therefore, when utilizing zinc and cadmium to enhance opacification of the pigmented processing layer, judicious selection of concentration is needed to avoid loss of carboxynaphthol phthalein absorption while maintaining the desired effect on the carboxyindole phthalein. Like the alkali earth metals, the zinc and cadmium may be added as the chlorides or other appropriate alkali soluble salt.

The amount of alkali earth metal salt and the amount of zinc or cadmium salt required to achieve the enhancement in opacification described above will vary according to a given photographic system. For example, the binding of metal cations, and particularly, the binding of the transition metal cations to the phthalein dyes may be influenced by polyethers (e.g., carbowaxes), polymeric silicates, ethylenediamine tetraacetic acid, imidazoles and other metal chelating agents which may be present in the processing composition. Whether or not the binding of metal to the phthalein dye will occur at a given level depends upon the strength of the metal-phthalein dye binding constant relative to that of the other chelates. Where the other chelating agents exert a significant effect, the attenuation of metal binding to the phthalein dyes may be overcome by increasing metal cation concentration or through pre-chelation, e.g., by pre-chelation of ethylenediamine tetraacetic acid with metal. Thus, it will be appreciated that the precise amount of alkali earth metal salt or of zinc or cadmium salt required for a given photographic system will be determined empirically. Ordinarily, barium chloride is used in amounts between about 0.15 and 1.5%; calcium chloride between about 0.5 and 1.5%; zinc chloride between about 0.25 and 0.5%; and cadmium chloride between about 1.0 and 1.5%, the amount selected being sufficient to attain improved opacification without hampering "clearing" to any significant extent, particularly clearing by the decolorizing layer that may be present immediately adjacent the interface between the processing composition and image-receiving element.

The use of a pod, i.e., a container releasably retaining a processing composition to distribute a layer of the composition between two predetermined layers of a photographic film unit is well known in the art. When such a container is ruptured, there is always some means, such as, gapped rollers, rails, etc. to meter the thickness of the layer spread. However, the actual amount of composition spread is not necessarily the amount predicted by the mechanical gap. It can be both larger and smaller. To some extent the spreading characteristics of the composition is a parameter in this determination. Though the system for providing a given amount of composition may be modelled mathematically for Newtonian fluids, in actual practice, the amount of composition spread is determined empirically. Ordinarily, there is no problem in achieving a desired result. A problem arises, however, when the composition somehow changes with time, for example, having established an empirical thickness, six months later a different result is obtained.

The beneficial effects achieved by employing colloidal silica in viscous processing compositions containing a light-reflecting pigment, such as, titanium dioxide are discussed in U.S. Pat. No. 3,776,726 issued Dec. 4, 1973. The colloidal silica seems to interact with other ingredients present to create a state in which more uniform and homogeneous spreading occurs. It has been observed, however, that the spreading characteristics as evidenced by the actual amount of composition spread at a given mechanical gap may at some future time change when certain other reagents, such as, metal chelating agents are present. At a given mechanical gap, the actual amount of composition spread tends to decrease after a certain period of time even though the metered thickness of the layer remains the same.

It has now been found that the judicious addition of alkali soluble calcium salts, preferably, calcium chloride can at least postpone undesirable changes in the spreading characteristics of the composition so that the actual amount spread at a given gap remains substantially the same over extended periods of time. The amount of calcium cation necessary for stabilizing the spreading characteristics in this manner depends upon the concentration of colloidal silica, other cations present and on the presence of chelates, such as, the aforementioned alkylene polyamine polyacetic acid and may be determined empirically. Ordinarily, the amount of calcium chloride used varies from about 0.1 to 2.0% by weight of the processing composition.

In carrying out the present invention, the pH-sensitive phthalein dye(s) preferably are initially disposed in the processing composition rather than in a layer of the film unit, and the alkali earth metal salts and the zinc and cadmium salts also are preferably included in the processing composition and preferably are included as the chloride salts.

As noted above, the present invention is particularly adapted for facilitating processing outside of a camera of diffusion transfer units which are maintained as a permanent integral laminate after processing, the final transfer image being viewed through one face of the laminate. In such film units a light-reflecting layer is disposed between the developed photosensitive layers and the layer carrying the transfer dye image. These essential layers preferably are confined between a pair of dimensionally stable outer supports, at least one of which is transparent to permit viewing of the transfer dye image by reflection against the background provided by the reflecting layer.

Image dye-providing materials which may be employed generally may be characterized as either (1) initially soluble or diffusible in the processing composition but are selectively rendered non-diffusible in an imagewise pattern as a function of development; or (2) initially insoluble or non-diffusible in the processing composition but which are selectively rendered diffusible or provide a diffusible product in an imagewise distribution as a function of development. These materials may be complete dyes or dye intermediates, e.g., color couplers. The requisite differential in mobility or solubility may, for example, be obtained by a chemical action such as a redox reaction or a coupling reaction.

As examples of initially soluble or diffusible materials and their application in color diffusion transfer processes, mention may be made of those disclosed, for example, in U.S. Pat. Nos. 2,968,554; 2,983,606; 3,087,817; 3,185,567; 3,230,082; 3,345,163; and 3,443,943. As examples of initially non-diffusible materials and their use in color transfer systems, mention may be made of the materials and systems disclosed in U.S. Pat. Nos. 3,185,567; 3,443,939; 3,443,940; 3,227,550; 3,227,552 and Published U.S. Application B-351,673. Both types of image dye-providing substances and film units useful therewith also are discussed in the aforementioned U.S. Pat. No. 3,647,437 to which reference may be made.

A particularly useful system for forming color images by diffusion transfer is that described in U.S. Pat. No. 2,983,606, employing dye developers (dyes which are also silver halide developing agents) as the image dye-providing materials. In such systems, a photosensitive element comprising at least one silver halide layer having a dye developer associated therewith (in the same or in an adjacent layer) is developed by applying an aqueous alkaline processing composition. Development of exposed silver halide results in oxidation of the dye developer to provide an oxidation product which is appreciably less diffusible than the unreacted dye developer, thereby providing an imagewise distribution of diffusible dye developer in terms of unexposed areas of the silver halide layer, which imagewise distribution is then tranferred, at least in part, by diffusion, to a dyeable stratum to impart thereto a positive dye transfer image.

In such color diffusion transfer systems, color transfer images are obtained by exposing a photosensitive element, sometimes referred to as a "negative component", comprising at least a light-sensitive layer, e.g., a gelatino silver halide emulsion layer, having an image dye-providing material associated therewith in the same or in an adjacent layer, to form a developable image; developing this exposed element with a processing composition to form an imagewise distribution of a diffusible image dye-providing material; and transferring this imagewise distribution, at least in part, by diffusion, to a superposed image-receiving layer, sometimes referred to as a "positive component", comprising at least a dyeable stratum to provide a color transfer image. The negative and positive components initially may be carried on separate supports which are brought together during processing and thereafter retained together as the final integral negative-positive reflection print, or they may initially comprise a unitary structure, e.g., integral negative-positive film units of the type described in aforementioned U.S. Pat. No. 3,415,644 wherein the negative and positive components are physically retained together in superposed relationship prior to, during and after image formation. (Procedures for forming such film units wherein the positive and negative components are temporarily laminated together prior to exposure are described, for example, in U.S. Pat. No. 3,652,281 to Albert J. Bachelder and Frederick J. Binda and in U.S. Pat. No. 3,652,282 to Edwin H. Land, both issued Mar. 28, 1972.) In either instance, the positive component is not removed from the negative component for viewing purposes. These components may be laminated together or otherwise secured together in physical juxtaposition.

Film units intended to provide multicolor images comprise two or more selectively sensitized silver halide layers each having associated therewith an appropriate image dye-providing material providing an image dye having spectral absorption characteristics substantially complementary to the light by which the associated silver halide is exposed. The most commonly employed negative components for forming multicolor images are of the tripack structure and contain blue-, green- and red-sensitive silver halide layers each having associated therewith in the same or in a contiguous layer a yellow, a magenta and a cyan image dye-providing material respectively. Interlayers or spacer layers may be provided between the respective silver halide layers and associated image dye-providing materials or between other layers. Indeed, a light-reflecting spacer layer disposed between a silver halide layer and the associated layer of image dye-providing material may be used to increase effective film speed as a result of the reflection of light back to the silver halide. Particularly suitable light-reflecting spacer layers comprise a light-reflecting pigment dispersed with inert polymeric particles which are substantially non-swelling in alkali and substantially non-film-forming. Such layers form the subject matter of copending U.S. patent application Ser. No. 267,417 of P. O. Kliem, P. H. Roth and R. Waack filed May 26, 1981.

In addition to the aforementioned layers, such film units further include means for providing a reflecting layer between the dyeable stratum and the negative component in order to mask effectively the silver image or images formed as a function of development of the silver halide layer or layers and also to mask image dye-providing material which is not transferred, thereby providing a background, preferably white, for viewing the color image formed in the dyeable stratum, without separation, by reflected light. Preferably, this reflecting layer is provided by including the reflecting agent in the processing composition. The dye transfer image is then viewable against the reflecting layer through a dimensionally stable protective layer or support. As noted above, most preferably another dimensionally stable layer or support is positioned on the opposed surface of the essential layers so that the aforementioned essential layers are between a pair of dimensionally stable layers or support members, one of which is transparent to permit viewing therethrough of the color transfer image. A rupturable container of known description contains the requisite processing composition and is adapted upon application of pressure to release its contents for development of the exposed film unit, e.g., by distributing the processing composition in a substantially uniform layer between the negative and positive components.

The dye developers (or other image dye-providing substances) are preferably selected for their ability to provide colors that are useful in carrying out subtractive color photography, that is, the previously mentioned cyan, magenta and yellow. They may be incorporated in the respective silver halide emulsion or, in the preferred embodiment, in a separate layer behind the respective silver halide emulsion. Thus a dye developer may, for example, be in a coating or layer behind the respective silver halide emulsion and such a layer of dye developer may be applied by use of a coating solution containing the respective dye developer distributed, in a concentration calculated to give the desired coverage of dye developer per unit area, in a film-forming natural, or synthetic, polymer, for example, gelatin, polyvinyl alcohol, and the like, adapted to be permeated by the processing composition.

Dye developers, as noted above, are compounds which contain the chromophoric system of a dye and also a silver halide developing function. By "a silver halide developing function" is meant a grouping adapted to develop exposed silver halide. A preferred silver halide development function is a hydroquinonyl group. Other suitable developing functions include ortho-dihydroxyphenyl and ortho- and para-amino substituted hydroxyphenyl groups. In general, the development function includes a benzenoid developing function, that is, an aromatic developing group which forms quinonoid or quinone substances when oxidized.

The image-receiving layer may comprise any of the materials known in the art, such as polyvinyl alcohol, gelatin, etc., preferably containing a mordant for the transferred image dye(s). If the color of the transferred image dye(s) is affected by changes in pH, the pH of the image layer may be adjusted to provide a pH affording the desired color.

In the various color diffusion transfer systems which have previously been described and which employ an aqueous alkaline processing fluid, it is well known to employ an acid-reacting reagent in a layer of the film unit to lower the environmental pH following substantial dye transfer in order to increase the image stability and/or to adjust the pH from the first pH at which the image dyes are diffusible to a second (lower) pH at which they are not. For example, the previously mentioned U.S. Pat. No. 3,415,644 discloses systems wherein the desired pH reduction may be effected by providing a polymeric acid layer adjacent the dyeable stratum. These polymeric acids may be polymers which contain acid groups, e.g., carboxylic acid and sulfonic acid groups, which are capable of forming salts with alkali; or potentially acid-yielding groups such as anhydrides or lactones. Preferably the acid polymer contains free carboxyl groups. Alternatively, the acid-reacting reagent may be in a layer adjacent the silver halide most distant from the image-receiving layer, as disclosed in U.S. Pat. No. 3,573,043 issued Mar. 30, 1971 to Edwin H. Land. Another system for providing an acid-reacting reagent is disclosed in U.S. Pat. No. 3,576,625 issued Apr. 27, 1971 to Edwin H. Land.

An inert interlayer or spacer layer may be used in association with the polymeric acid layer to control or "time" the pH reduction so that it is not premature and interfere with the development process. Suitable spacer or "timing" layers useful for this purpose are described with particularity in U.S. Pat. Nos. 3,362,819; 3,419,389; 3,421,893; 3,455,686; and 3,575,701.

As is now well known and illustrated, for example, in the previously cited patents, the liquid processing composition referred to for effecting multicolor diffusion transfer processes comprises at least an aqueous solution of an alkaline material and possesses a pH of at least 12. Preferably, the alkaline material employed in the subject invention, is an alkali metal hydroxide, particularly potassium hydroxide. Though the alkali metals exert some effect on the pKa of the carboxyindole phthalein optical filter agent following the natural periodic order of $Li^+ > Na^+ > K^+ > Cs^+$, the differences in pKa values obtained with these metals is so slight that differences in the transmission density of the processing composition are not measurable.

The processing composition also preferably includes a viscosity-imparting reagent constituting a film-forming material of the type which, when the composition is spread and dried, forms a relatively firm and relatively stable film. This reagent may be a cellulosic polymer, for example, hydroxyethyl cellulose or sodium carboxymethyl cellulose; an oxime polymer, for example, polydiacetone acrylamide oxime; or other alkali-stable high molecular weight polymer. The viscosity-imparting reagent is preferably contained in the processing composition in such suitable quantities as to impart to the composition a viscosity in excess of 100 cps. at a temperature of approximately 24° C. and preferably in the order of 100,000 cps. to 200,000 cps. at that temperature.

As mentioned previously, the pH-sensitive phthalein dye(s) employed as the light-absorbing optical filter agents preferably are initially contained in the processing composition in their colored form together with the selected metal salts and a light-reflecting material, for example, titanium dioxide. In a particularly useful embodiment, the light-absorbing dye is highly colored at the pH of the processing composition, e.g., 13–14, but is substantially non-absorbing of visible light at a lower pH, e.g., less than 10–12. Particularly suitable are the carboxynaphthol phthaleins and the carboxyindole phthaleins having a pKa of at least about 12.5; many such dyes are disclosed in aforementioned U.S. Pat. Nos. 3,647,437, 3,702,244 and 3,702,245.

The concentration of phthalein dye is selected to provide the optical transmission density required, in combination with the other layers intermediate the silver halide emulsion layer(s) and the incident radiation, to prevent nonimagewise exposure, i.e., fogging by incident actinic light during performance of the particular photographic process. The transmission density and the concentration of phthalein dye (and metal salt) necessary to provide the requisite protection from incident light may be readily determined for any photographic process by routine experimentation, as a function of film speed or sensitivity, thickness of the opacification layer, processing time, anticipated incident light intensity, etc., as described in said U.S. Pat. No. 3,647,437. It will be recognized that a particular transmission density may not be required for all portions of the spectrum, lesser density being sufficient in wavelength regions corresponding to lesser sensitivities of the particular photosensitive material. Also, it will be recognized that a mixture of the phthalein dyes may be used to obtain absorption in all critical areas of the visible and near-visible by which the silver halide emulsions being used are exposable.

Where the light-absorbing phthalein optical filter agent is present in the processing composition, it is advantageous to utilize an image-receiving component having a surface layer adapted to decolorize the optical filter agent adjacent the interface between said component and the layer of processing composition. Suitable decolorizing layers are described in aforementioned U.S. Pat. No. 4,298,674 of Edwin H. Land, Leon D. Cerankowski and Neil C. Mattucci, in U.S. Pat. No. 4,294,907 of Irena Bronstein-Bonte, Edward P. Lindholm and Lloyd D. Taylor and in U.S. Pat. No. 4,367,277 of Charles K. Chiklis and Neil C. Mattucci. Of the several "clearing coats" described, the unhardened gelatin clearing coat disclosed and claimed in said last named patent is presently preferred.

The present invention will be further illustrated by the following example which is given for purposes of illustration only.

EXAMPLE 1

A multicolor photosensitive component using, as the cyan, magenta and yellow dye developers:

cyan:

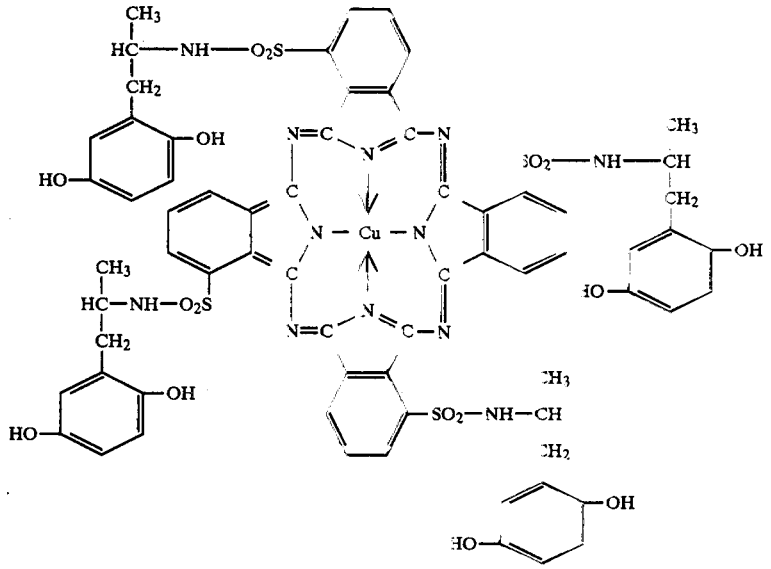

magenta:

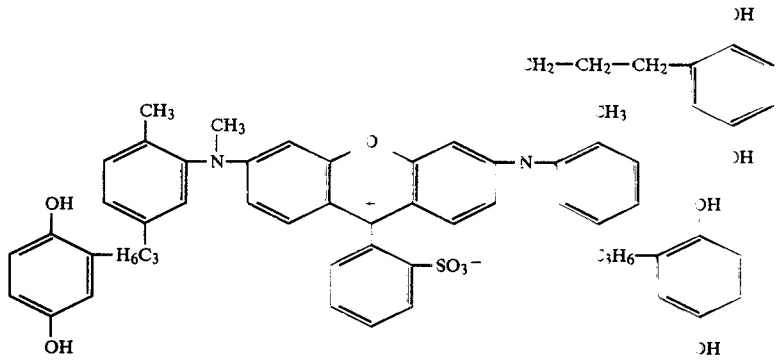

yellow:

-continued

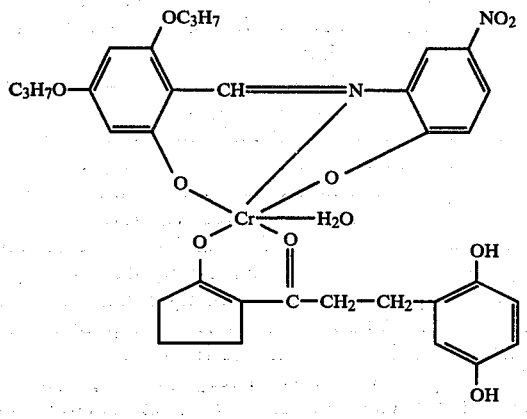

was prepared by coating an opaque polyethylene terephthalate film base with the following layers.

(1) A neutralizing layer of a partial butyl ester of polyethylene/maleic anhydride copolymer at a coverage of about 23,700 mg/m$^2$ and polyvinylbutyral at a coverage of about 2,600 mg/m$^2$.

(2) A timing layer of a 60.6/29/6.3/3.7/0.4 pentapolymer of butylacrylate, diacetone acrylamide, stryene, methacrylic acid and acrylic acid at a coverage of about 3,500 mg/m$^2$ and about 524 mg/m$^2$ of gelatin.

(3) A layer of a gelatin dispersion of a cyan dye developer, 6-dodecylaminopurine, and 4'-methylphenylhydroquinone coated at a coverage of about 600 mg/m$^2$ of dye, 225 mg/m$^2$ of 6-dodecylaminopurine, 120 mg/m$^2$ of 4'-methylphenylhydroquinone, and 300 mg/m$^2$ of gelatin.

(4) A spacer layer of titanium dioxide, poly(methylmethacrylate), gelatin, the above pentapolymer, and polyacrylamide coated at a coverage of about 1,000 mg/m$^2$ of titanium dioxide, 375 mg/m$^2$ of poly(methylmethacrylate), 125 mg/m$^2$ of gelatin, 375 mg/m$^2$ of said pentapolymer, and 270 mg/m$^2$ of polyacrylamide.

(5) A red-sensitive gelatino-silver iodobromide (1.8 micron) emulsion layer coated at a coverage of about 1,300 mg/m$^2$ of silver and 1,014 mg/m$^2$ of gelatin.

(6) An interlayer of the above pentapolymer coated at a coverage of about 3,000 mg/m$^2$, about 158 mg/m$^2$ of polyacrylamide and about 32 mg/m$^2$ of succindialdehyde.

(7) A layer of gelatin dispersion of a magenta dye developer and 6-dodecylaminopurine coated at a coverage of about 575 mg/m$^2$ of dye, 280 mg/m$^2$ of gelatin and 23 mg/m$^2$ of 6-dodecylaminopurine.

(8) A green-sensitive gelatino-silver iodobromide emulsion layer comprising a blend of 1.1 micron grains coated at a coverage of about 373 mg/m$^2$ of silver and 60 mg/m$^2$ of gelatin and 1.8 micron grains coated at a coverage of about 1,027 mg/m$^2$ of silver and 504 mg/m$^2$ of gelatin.

(9) An interlayer of the above pentapolymer coated at a coverage of about 2,500 mg/m$^2$, about 130 mg/m$^2$ of polyacrylamide, about 31 mg/m$^2$ of succindialdehyde and about 4 mg/m$^2$ of formaldehyde. (10) A layer of 2-phenylbenzimidazole and gelatin coated at a coverage of about 250 mg/m$^2$ of 2-phenylbenzimidazole and 100 mg/m$^2$ of gelatin.

(11) A layer of a gelatin dispersion of a yellow dye developer coated at a coverage of about 800 mg/m$^2$ of dye and 320 mg/m$^2$ of gelatin.

(12) A spacer layer of titanium dioxide, poly(methylmethacrylate) and polyacrylamide coated at a coverage of about 200 mg/m$^2$ of titanium dioxide, 150 mg/m$^2$ of poly(methylmethacrylate) and 40 mg/m$^2$ of polyacrylamide.

(13) A blue-sensitive gelatino-silver iodobromide emulsion layer comprising 1.5 micron grains coated at a coverage of about 950 mg/m$^2$ of silver, 456 mg/m$^2$ of gelatin, 250 mg/m$^2$ of 4'-methylphenylhydroquinone, and about 340 mg/m$^2$ of diethyldodecanamide.

(14) A top coat layer of gelatin coated at a coverage of about 484 mg/m$^2$.

An image-receiving component was prepared by coating a transparent polyethylene terephthalate film base with the following layers.

1. an image-receiving layer coated at a coverage of about 300 mg/ft$^2$ (about 3,230 mg/m$^2$) of a graft copolymer comprising 4-vinyl pyridine (4VP) and vinyl benzyl trimethyl ammonium chloride (TMQ) grafted onto hydroxyethyl cellulose (HEC) at a ratio HEC/4VP/TMQ of 2.2/2.2/1, and about 4 mg/ft$^2$ of 1,4-butanediol diglycidyl ether cross-linking agent; and 2. a layer of unhardened inert bone gelatin coated at a coverage of about 100 mg/ft$^2$ (about 1,076 mg/m$^2$).

The two components thus prepared were then taped together with a rupturable container retaining an aqueous alkaline processing composition mounted on the leading edge of these components, so that, upon application of compressive pressure to rupture the container, its contents are distributed in a layer between the inert bone gelatin layer 2 of the image-receiving component and the gelatin top coat layer (14) of the photosensitive component.

The aqueous alkaline processing composition comprised:

| Ingredient | Weight % |
|---|---|
| Water | 41.40 |
| Titanium dioxide | 48.40 |
| Potassium hydroxide (100%) | 4.60 |
| Polydiacetone acrylamide oxime | 0.67 |
| Benzotriazole | 0.46 |
| 4-aminopyrazolo-(3,4d)-pyrimidine | 0.21 |
| 6-methyl uracil | 0.25 |
| N—2-hydroxyethyl-N,N',N'—tris-carboxymethylethylene diamine | 0.63 |
| Polyethylene glycol (mol. wt. about 4000) | 0.38 |
| Allopurinol | 0.07 |
| Bis(2-aminoethyl)sulfide | 0.017 |
| Colloidal silica (30% dispersion) | 0.23 |
| N—phenethyl-α-picolinium bromide | 1.07 |

-continued

| Ingredient | Weight % |
|---|---|
| 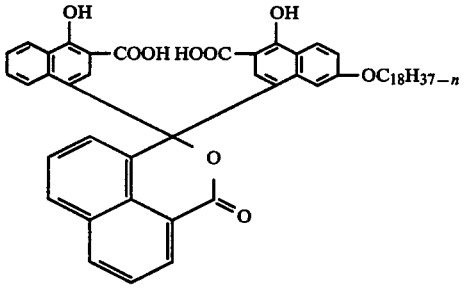 3-(3'-carboxy-4'hydroxy-1'-naphthyl)-3-(3''-carboxy-4''-hydroxy-7''-octadecyloxy-1''-naphthyl)naphthalide | 1.30 |
| 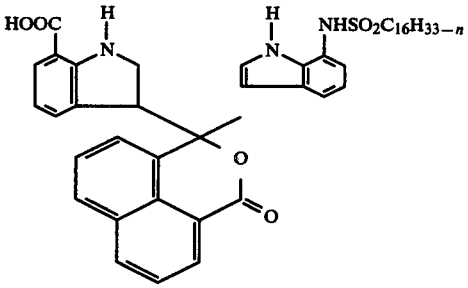 3-(7-carboxyindol-3-yl)-3-(7-hexadecylsulfonamido indol-3-yl)naphthalide | 0.29 |

The unexposed film unit was passed between a pair of pressure rolls so that a layer approximately 0.0024 inch thick of processing composition was distributed between said layers 2 and (14). The resulting laminate was brought into and kept under simulated sunlight of 10,000 foot-candles for 30 seconds.

Two additional film units were prepared in the same manner described above and were identical except for the processing compositions which contained 0.1% barium chloride and 0.2% barium chloride, respectively. These film units were processed in the same way by passing them through pressure rolls to distribute the processing composition in a layer approximately 0.0024 inch thick and then bringing them into simulated sunlight of 10,000 foot-candles for 30 seconds.

The quantity of processing composition used for processing each of the three film units was 650 mgs/9.57 sq.in.

As visually observed, there was very little transfer of image dye in the control (without barium chloride). At the 0.1% level of barium chloride, fogging was significantly reduced, and at the 0.2% level, density of the transfer image essentially was not reduced.

In a further comparison, additional film units were prepared as described in Example 1 and were processed in the same manner except for the quantity of processing composition employed. As a control, five film units were processed with the above-denoted processing composition (without barium cation present) using amounts ranging between about 640 and 820 mgs. Four film units were processed with the above-denoted processing composition containing 0.2% barium chloride using amounts ranging between about 620 and 775 mgs. After passing the film units through the pressure rolls and bringing them into simulated sunlight of 10,000 foot-candles for 30 seconds, the red density for each film unit was measured by reflectance. The results obtained are shown in FIG. 1 wherein the red density for each of the control film units and the red density for each of the film units processed with barium chloride present are plotted against the quantity of processing composition used to process each film unit. From reference to this figure, it can be seen that the presence of barium chloride enhances opacification in that the same level of protection can be achieved with lesser amounts of processing composition. For example, a red density of approximately 1.2 was obtained using about 700 mgs. of processing composition containing barium chloride whereas about 750 mgs. of the control composition was required to achieve the same red density level.

In addition to the above photographic experiments, the effect of metal cations on the reflectance densities of a pigmented processing composition were measured spectrophotometrically. The results are shown in FIGS. 2 to 4 and were obtained by adding the metal chloride to a pigmented processing composition, spreading the composition between two transparent sheets of polyethylene terephthalate in a layer approximately 0.0026 inch thick, and then measuring the reflectance density of each processing composition layer over the wavelength range of 380 to 700 nm.

Figure 2:
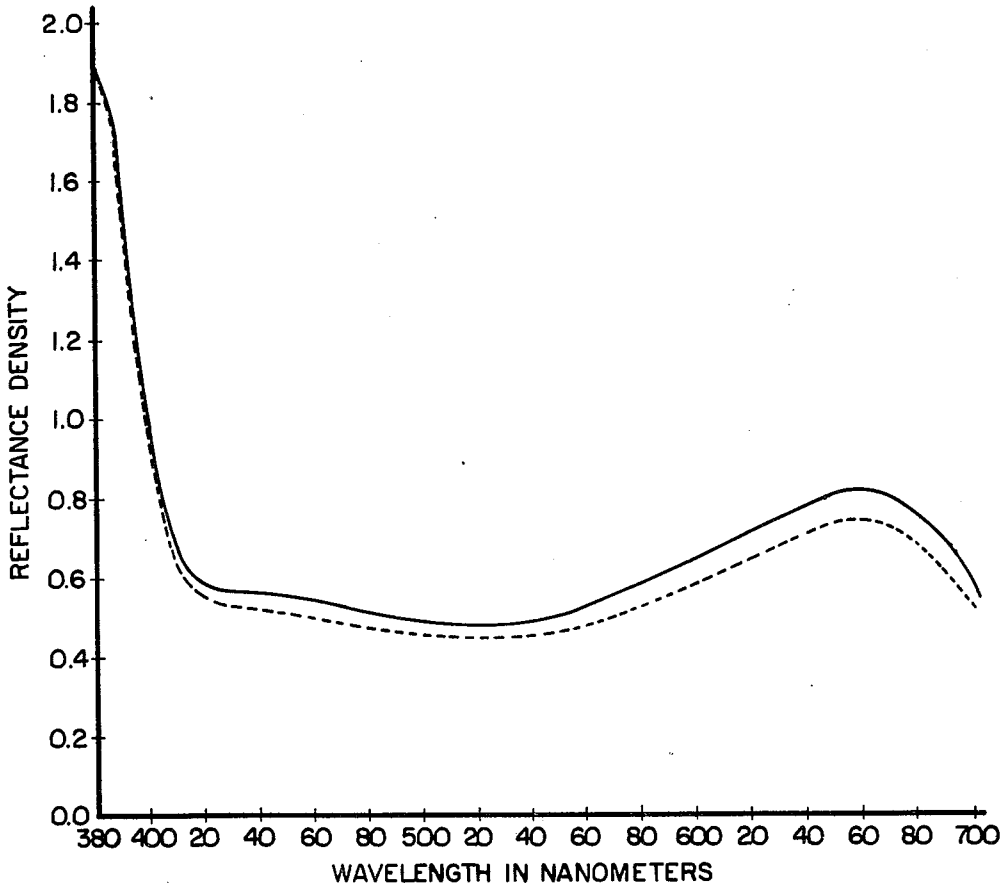
FIGS. 2 to 4 are graphic illustrations showing the effect of certain metal cations on the reflectance densities of pigmented processing compositions over the wavelength range of 380 to 700 nanometers wherein curve A in these figures represents the control processing composition.
Figure 3:
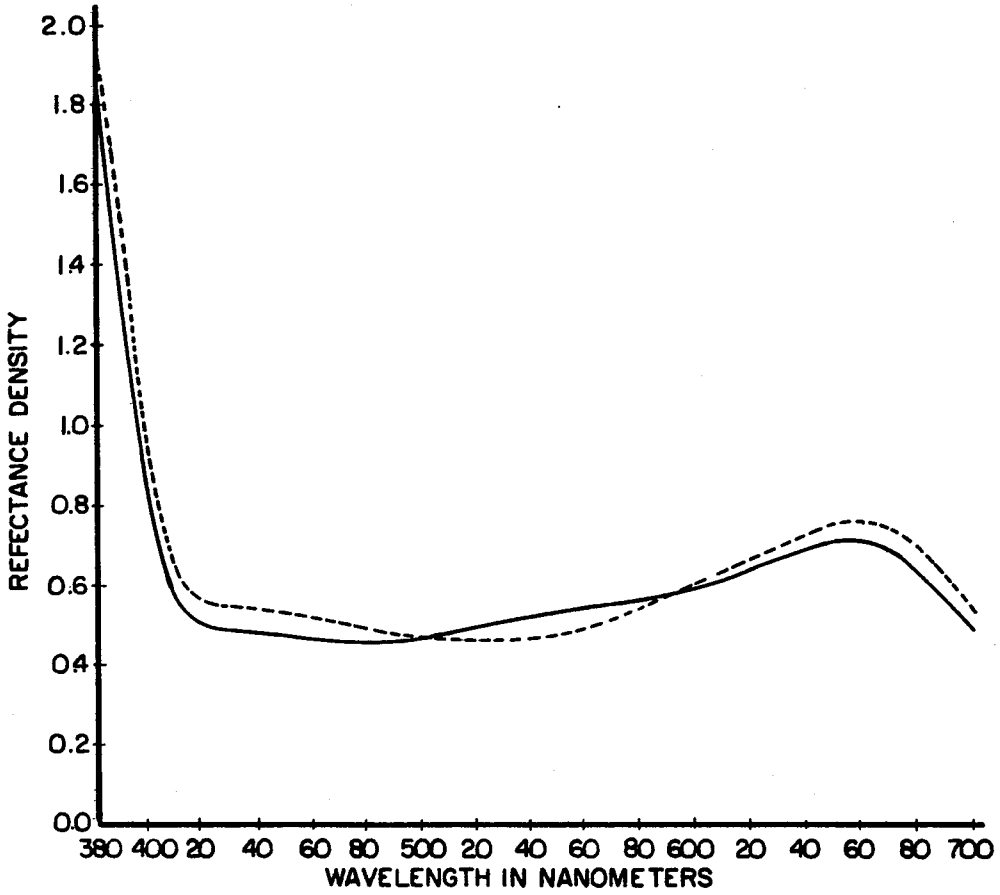
Figure 4:
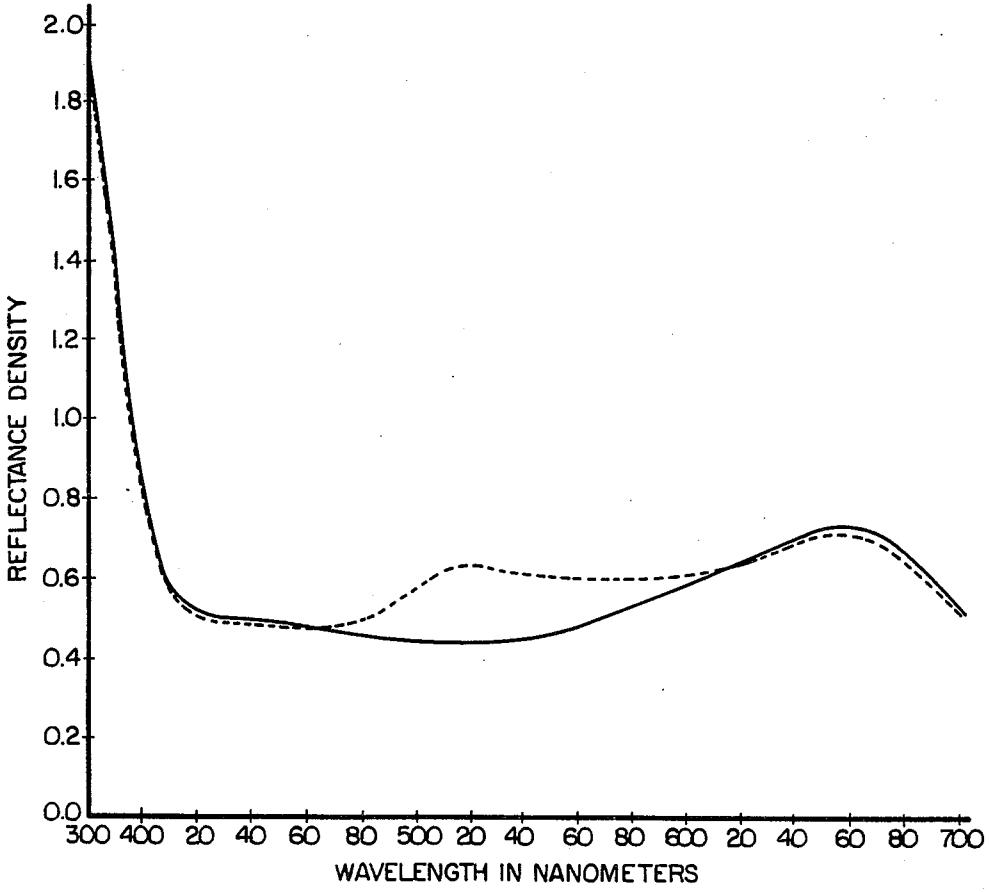

Curve A in FIGS. 2 to 4 represents the reflectance density for the control, i.e., the processing composition containing the following ingredients.

| Ingredient | Weight % |
|---|---|
| Water | 41.40 |
| Titanium dioxide | 48.40 |
| Potassium hydroxide (100%) | 4.60 |
| Polydiacetone acrylamide oxime | 0.67 |
| Benzotriazole | 0.46 |
| 4-aminopyrazolo-(3,4d)-pyrimidine | 0.21 |
| 6-methyl uracil | 0.25 |
| N—2-hydroxyethyl-N,N',N'—tris-carboxymethyl-ethylene diamine | 0.63 |
| Polyethylene glycol (mol. wt. about 4000) | 0.38 |
| Allopurinol | 0.07 |
| Bis(2-aminoethyl)sulfide | 0.017 |
| Colloidal silica (30% dispersion) | 0.23 |
| N—phenethyl-α-picolinium bromide | 1.07 |
| 3-(3'-carboxy-4'-hydroxy-1'-naphthyl)-3-(3''-carboxy-4''-hydroxy-7''-octadecyloxy-1''-naphthyl)naphthalide | 1.30 |
| 3-(7-carboxyindol-3yl)-3-(7-hexadecyl-sulfonamidoindol-3-yl)naphthalide | 0.29 |

Curve B in FIG. 2 represents the reflectance density obtained with 1.5% barium chloride added to the above-denoted processing composition; curve C in FIG. 3 represents the reflectance density obtained with 0.25% zinc chloride added to the above-denoted processing composition; and curve D in FIG. 4 represents the reflectance density obtained with 1.5% cadmium chloride added to the above-denoted processing composition.

As readily apparent from reference to these figures, the addition of barium cation increases the reflectance density in the 400 to 700 nm wavelength range and the addition of zinc and cadmium cations selectively increase the reflectance density in the 500 to 600 nm wavelength range.

To illustrate the beneficial effect of using calcium chloride to stabilize the spreading characteristics of alkaline processing compositions, three processing compositions designated A, B and C were prepared having the ingredients set forth in Table I below.

TABLE I

| Ingredient | Processing Composition (Wt %) A | B | C |
|---|---|---|---|
| Water | 41.0 | 40.4 | 40.5 |
| Titanium dioxide | 46.7 | 46.7 | 47.4 |
| Potassium hydroxide (100%) | 4.80 | 5.38 | 4.51 |
| Polydiacetone acrylamide oxime | 0.65 | 0.65 | 0.66 |
| Benzotriazole | 0.44 | 0.44 | 0.45 |
| 6-Hydroxy-4-amino-pyrazolopyrimidine | 0.24 | 0.24 | — |
| Citric Acid | 0.30 | 0.30 | — |
| 6-methyl uracil | — | — | 0.25 |
| N—2-hydroxyethyl-N,N',N'—tris-carboxymethylethylene diamine | 1.21 | — | 1.21 |
| 6-Bromo-5-methyl-4-azobenzimidazole | 0.10 | 0.10 | 0.10 |
| 3,5-Dimethylpyrazole | — | — | 0.16 |
| 2-Methylimidazole | 0.67 | 0.67 | 0.68 |
| 1-(4-Hydroxyphenyl)-tetrazoline-5-thione | 0.038 | 0.038 | 0.039 |
| Nickel acetate | 0.40 | 0.40 | 0.40 |
| Colloidal silica (30% dispersion) | 0.22 | 0.22 | 0.23 |
| N—phenethyl pyridinium bromide | 0.20 | 0.20 | — |
| N—phenethyl-α-picolinium bromide | 1.33 | 1.33 | 1.25 |
| Hypoxanthine | — | — | 0.10 |
| 3-(3'-carboxy-4'-hydroxy-1'-naphthyl)-3-(3''-carboxy-4''-hydroxy-7''-octadecyloxy-1''-naphthyl)naphthalide | 1.45 | 1.45 | 1.37 |
| 3-(7-carboxyindol-3yl)-3-(7-hexadecylsulfonamidoindol-3-yl)naphthalide | 0.42 | 0.42 | 0.29 |
| Calcium Chloride | 0.39 | 0.39 | 0.39 |

The spreading characteristics of the three test compositions A, B and C were monitored over a period of time at storage temperatures of 50° C. and 70° C. and compared to control compositions which were identical to A, B and C, respectfully, except that the calcium chloride was omitted. The results obtained are set forth in Table II below wherein the days (or weeks) reflects the time period until the spreading characteristics began to change, i.e., the amount of composition spread at a gap of 0.0030 inch decreased from about 900 mg. utilized to about 750 mg/9.57 sq.in.

TABLE II

| Processing Composition | 70° C. (days) Control | Test | 50° C. (weeks) Control | Test |
|---|---|---|---|---|
| A | 18 | 30 | 11 | 17 |
| B | 15 | 26 | 7 | 15 |
| C | 18 | 30 | 11 | 17 |

From the data set forth above, it is apparent that the inclusion of calcium chloride in the processing compositions extended the stability of the spreading characteristics quite substantially before the composition began to show signs of thinning which results in decreased amounts spread and utilized at a given gap. In a further experiment conducted at 25° C., it was found that composition C with 0.39% calcium chloride was stable for 24 months compared to 14 months for the control.

It will be appreciated that other viscosity-imparting reagents may be used in the above processing compositions, for example, the cellulosic polymers discussed in aforementioned U.S. Pat. No. 3,776,726. Also, other metal chelating agents may be employed, preferably alkylene polyamine polyacetic acids, such as, ethylenediamine tetraacetic acid, diethylene triamine pentaaccetic acid, triethylene tetramine hexacetic acid and similar chelating agents containing the group

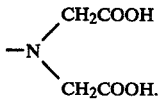

The use of such metal chelating agents to prevent stain in certain integral negative-positive diffusion transfer photographic products and processes is described in U.S. Pat. No. 3,856,521. Other light-reflecting pigments also may be used though titanium dioxide is preferred.

Though the present invention has been illustrated employing dye developers as the preferred image providing material, it will be understood that this invention is applicable to a wide variety of photographic processes employing other image providing materials and that the transfer image may be in silver or in dye. For example, other suitable image dye-providing materials capable of providing an imagewise distribution of diffusible dye as a function of development include the initially diffusible and the initially non-diffusible materials discussed previously. Where the transfer image is in silver, the image providing material comprises an imagewise distribution of soluble silver complex capable of diffusing to the image-receiving layer and forming a silver image thereon. Since these image-forming processes are well known and form no part per se of the present invention, it is not necessary to describe them in detail.

It will be understood that in any of these photographic systems, the transfer image may be positive or negative with respect to the photographed subject matter as a function of the particular image-forming system and that the silver halide emulsion may be negative-working or positive-working. Likewise, the image-receiving layer or other layers of the negative and positive components may vary as appropriate for a given process.

Since certain changes may be made in the above subject matter without departing from the scope of the invention herein involved, it is intended that all matter contained in the above description or shown in the accompanying drawings shall be interpreted as illustrative and not in a limiting sense.

What is claimed is:

1. In a photographic process for forming a diffusion transfer image viewable as a reflection print which includes the steps of applying a layer of aqueous alkaline processing composition comprising a light-reflecting pigment and at least one light-absorbing pH-sensitive optical filter agent between a negative component comprising an exposed silver halide emulsion carried on a support and a positive component comprising an image-receiving layer carried on a transparent support; said layer of processing composition being effective to develop said exposed silver halide emulsion and to form a visible image in said image-receiving layer and being effective to prevent transmission of light actinic to said silver halide emulsion during development thereof; and after a predetermined time, reducing the pH of said processing composition layer to a pH effective to decolorize said pH-sensitive optical filter agent; said pH reduction being effected by an acid-reacting layer disposed in at least one of said negative and positive components;

the improvement which comprises applying as said processing composition layer, an aqueous solution of alkali metal hydroxide comprising a light-reflecting pigment, a carboxynaphthol phthalein optical filter agent and an alkali soluble alkali earth metal salt in an amount sufficient to increase the transmission density of said processing composition layer at a fixed concentration of said carboxynaphthol phthalein.

2. A photographic process as defined in claim 1 wherein said processing composition additionally includes a viscosity-imparting reagent.

3. A photographic process as defined in claim 2 wherein said viscosity-imparting reagent is a cellulosic polymer.

4. A photographic process as defined in claim 2 wherein said viscosity-imparting reagent is an oxime polymer.

5. A photographic process as defined in claim 1 wherein said light-reflecting pigment is titanium dioxide.

6. A photographic process as defined in claim 1 wherein said alkali metal hydroxide is potassium hydroxide.

7. A photographic process as defined in claim 1 wherein said alkali earth metal salt is a barium salt.

8. A photographic process as defined in claim 7 wherein said barium salt is barium chloride.

9. A photographic process as defined in claim 1 wherein said alkali earth metal salt is a calcium salt.

10. A photographic process as defined in claim 9 wherein said calcium salt is calcium chloride.

11. A photographic process as defined in claim 1 wherein said processing composition additionally includes a pH-sensitive carboxyindole phthalein optical filter agent.

12. A photographic process as defined in claim 11 wherein said processing composition additionally includes an alkali soluble bivalent transition metal salt selected from a zinc salt, a cadmium salt and mixtures thereof in an amount sufficient to increase the transmission density of said processing composition layer in the green region of the spectrum at a fixed concentration of said carboxyindole phthalein.

13. A photographic process as defined in claim 12 wherein said bivalent transition metal salts are chlorides.

14. A photographic process as defined in claim 1 wherein said positive component additionally includes a substantially non-diffusible decolorizing agent in a layer in contact with said processing composition layer, said decolorizing agent being adapted to decolorize, without pH-reduction, said carboxynaphthol phthalein optical filter agent adjacent to the interface between said decolorizing layer and said processing composition layer without substantially decreasing the transmission density of said processing composition layer.

15. A photographic process as defined in claim 14 wherein said decolorizing agent is unhardened gelatin.

16. A photographic process as defined in claim 1 wherein said visible image formed in said image-receiving layer is a dye image.

17. A photographic process as defined in claim 16 wherein said dye is a dye developer.

18. In a photographic film unit adapted for forming a transfer image viewable as a reflection print including a negative component comprising a photosensitive silver halide emulsion carried on a support; a positive component comprising an image-receiving layer carried on a transparent support; an acid-reacting layer disposed in at least one of said negative and positive components; and an aqueous alkaline processing composition comprising a light-reflecting pigment and at least one light-absorbing, pH sensitive optical filter agent releasably contained in a rupturable container positioned to release said composition for distribution between said negative and said positive components, the combination of said light-reflecting pigment and said optical filter agent being effective to prevent further exposure of said photosensitive emulsion during processing in the presence by radiation actinic to said emulsion and said light-reflecting pigment providing layer after development which is effective to mask said photosensitive layer and provide a background for viewing the transfer image by reflected light;

the improvement which comprises employing as said processing composition, an aqueous solution of alkali metal hydroxide comprising a light-reflecting pigment, a carboxynaphthol phthalein optical filter agent and an alkali soluble alkali earth metal salt in an amount sufficient to increase the transmission density of said processing composition layer distributed between said negative and positive components at a fixed concentration of said carboxynaphthol phthalein.

19. A photographic product as defined in claim 18 wherein said processing composition additionally includes a viscosity-imparting reagent.

20. A photograhic product as defined in claim 19 wherein said viscosity-imparting reagent is a cellulosic polymer.

21. A photographic product as defined in claim 19 wherein said viscosity-imparting reagent is an oxime polymer.

22. A photographic product as defined in claim 18 wherein said light-reflecting pigment is titanium dioxide.

23. A photographic product as defined in claim 18 wherein said alkali metal hydroxide is potassium hydroxide.

24. A photographic product as defined in claim 18 wherein said alkali earth metal salt is a barium salt.

25. A photographic product as defined in claim 24 wherein said barium salt is barium chloride.

26. A photographic product as defined in claim 18 wherein said alkali earth metal salt is a calcium salt.

27. A photographic product as defined in claim 26 wherein said calcium salt is calcium chloride.

28. A photographic product as defined in claim 18 wherein said processing composition additionally includes a pH-sensitive carboxindole phthalein optical filter agent.

29. A photographic product as defined in claim 28 wherein said processing composition additionally includes an alkali soluble bivalent transition metal salt selected from a zinc salt, a cadmium salt and mixtures thereof in an amount sufficient to increase the transmission density of said processing composition layer in the green region of the spectrum and at a fixed concentration of said carboxyindole phthalein.

30. A photographic product as defined in claim 29 wherein said bivalent transition metal salts are chlorides.

31. A photographic product as defined in claim 30 wherein said positive component additionally includes a substantially non-diffusible decolorizing agent in a layer positioned to be in contact with the processing composition layer following distribution thereof, said decolorizing agent being adapted to decolorize said phthalein optical filter agent, without pH-reduction, immediately adjacent the interface between said processing composition layer and said decolorizing layer without substantially decreasing the transmission density of said processing composition layer.

32. A photographic product as defined in claim 31 wherein said decolorizing agent is unhardened gelatin.

33. A photographic product as defined in claim 18 wherein an image dye-providing material is associated with said photosensitive silver halide emulsion, said image dye-providing material being adapted to provide a dye diffusible to said image-receiving layer for forming a dye image.

34. A photographic product as defined in claim 33 wherein said image dye-providing material is a dye developer.

35. A rupturable container for use in diffusion transfer film units adapted to provide transfer images viewable by reflected light, said rupturable container releasably holding an aqueous alkaline processing composition comprising an aqueous solution of alkali metal hydroxide, a light-reflecting pigment; at least one light-absorbing, pH-sensitive optical filter agent, one said filter agent being a carboxynaphthol phthalein; and an alkali soluble alkali earth metal salt in an amount such that a layer of said composition exhibits an increase in transmission density at a fixed concentration of said carboxynaphthol phthalein.

36. A rupturable container releasably holding an aqueous alkaline processing composition as defined in claim 35 wherein said processing composition additionally includes a viscosity-imparting reagent.

37. A rupturable container releasably holding an aqueous alkaline processing composition as defined in claim 36 wherein said viscosity-imparting reagent is a cellulosic polymer.

38. A rupturable container releasably holding an aqueous alkaline processing composition as defined in claim 36 wherein said viscosity-imparting reagent is an oxime polymer.

39. A rupturable container releasably holding an aqueous alkaline processing composition as defined in claim 35 wherein said light-reflecting pigment is titanium dioxide.

40. A rupturable container releasably holding an aqueous alkaline processing composition as defined in claim 35 wherein said alkali metal hydroxide is potassium hydroxide.

41. A rupturable container releasably holding an aqueous alkaline processing composition as defined in claim 35 wherein said alkali earth metal salt is a barium salt.

42. A rupturable container releasably holding an aqueous alkaline processing composition as defined in claim 41 wherein said barium salt is barium chloride.

43. A rupturable container releasably holding an aqueous alkaline processing composition as defined in claim 35 wherein said alkali earth metal salt is a calcium salt.

44. A rupturable container releasably holding an aqueous alkaline processing composition as defined in claim 43 wherein said calcium salt is calcium chloride.

45. A rupturable container releasably holding an aqueous alkaline processing composition as defined in claim 35 wherein said processing composition additionally includes a pH-sensitive carboxyindole phthalein optical filter agent.

46. A rupturable container releasably holding an aqueous alkaline processing compositon as defined in claim 45 wherein said processing composition additionally includes an alkali soluble bivalent transition metal salt selected from a zinc salt, a cadmium salt and mixtures thereof in an amount such that a layer of said composition exhibits an increase in transmission density in the green region of the spectrum at a fixed concentration of said carboxyindole phthalein.

47. A rupturable container releasably holding an aqueous alkaline processing composition as defined in claim 46 wherein said bivalent transition metal salts are chlorides.

48. A rupturable container releasably holding an aqueous alkaline processing composition as defined in claim 47 wherein said bivalent transition metal chloride is zinc chloride.

49. A rupturable container releasably holding an aqueous alkaline processing compositoin as defined in claim 47 wherein said bivalent transition metal chloride is cadmium chloride.

* * * * *